United States Patent [19]

Goldstein et al.

[11] 4,283,233

[45] Aug. 11, 1981

[54] METHOD OF MODIFYING THE TRANSITION TEMPERATURE RANGE OF TINI BASE SHAPE MEMORY ALLOYS

[75] Inventors: David Goldstein, Adelphia; Richard E. Jones; Robert S. Sery, both of Silver Spring, all of Md.

[73] Assignee: The United States of America as represented by the Secretary of the Navy, Washington, D.C.

[21] Appl. No.: 128,326

[22] Filed: Mar. 7, 1980

[51] Int. Cl.[3] ..... C22F 1/10

[52] U.S. Cl. ..... 148/11.5 R; 148/11.5 F; 148/11.5 N

[58] Field of Search ..... 148/11.5 N, 11.5 F, 148/11.5 R

[56] References Cited

U.S. PATENT DOCUMENTS

| | | | |
|---|---|---|---|
| 3,174,851 | 3/1965 | Buehler et al. | 75/170 |
| 3,753,700 | 8/1973 | Harrison et al. | 75/170 |
| 4,144,057 | 3/1979 | Melton et al. | 75/170 |

OTHER PUBLICATIONS

Buehler et al., 55–Nitinol, Unique Wire Alloy with a Memory, Wire Journal, Jun. 1969.

*Primary Examiner*—R. Dean

*Attorney, Agent, or Firm*—R. S. Sciascia; A. L. Branning; R. D. Johnson

[57] ABSTRACT

A method of changing the shape change transition temperature range (TTR) of an object made from a nickel-titanium based shape change memory alloy by selection of the final annealing temperature.

4 Claims, 3 Drawing Figures

METHOD OF MODIFYING THE TRANSITION TEMPERATURE RANGE OF TINI BASE SHAPE MEMORY ALLOYS

BACKGROUND OF THE INVENTION

This invention relates to metal alloys and more particularly to nickel-titanium base metal alloys which have shape change The Nitinol alloys are nickel-titanium-base metal alloys having shape change memories. The general method for using the memory properties of these alloys is to:

(1) shape the alloy into a permanent form at a temperature below the temperature transition range (TTR);

(2) constrain the alloy in this shape;

(3) anneal the alloy at 500° C.;

(4) cool the alloy to a temperature below the TTR;

(5) remove the constraint; and (6) shape the alloy into an another form.

The alloy can then be converted from its other shape to its permanent shape by heating it to a temperature above the TTR. An excellent discussion about the theories and properties of Nitinol is given by William J. Buehler and William B. Cross, "55-Nitinol: Unique Wire Alloy with a Memory," *Wire Journal,* June 1969. Methods of preparing Nitinol are disclosed in U.S. Pat. No. 3,174,851, entitled "Nickel-Base Alloys," which issued to Buehler and Wiley on Mar. 23, 1965. The shape change memory properties of nickel-titanium alloys containing from 53.5 to 56.5 weight percent nickel, the remainder being titanium, are disclosed in U.S. Pat. No. 3,403,238 entitled "Conversion of Heat Energy to Mechanical Energy," which issued to William J. Buehler and David M. Goldstein on Sept. 24, 1968.

In the prior art, the usual method of changing the TTR was to change the ratio of nickel to titanium or to substitute cobalt or iron for nickel. A limitation of this previous method of alloying, has been the requirement to prepare by melting a different composition of alloy for each different transition temperature desired. This limitation presents significant economic disadvantages to the manufacturer of these alloys. In addition to an infinite number of TTR possibilities, it is difficult to precision alloy to control to a pre-selected composition. For example, a shift in total cobalt on the order of 0.2% of the total composition can change the midpoint (50% recovery) of the TTR by 8° C., an unacceptable amount in many applications. Even worse from the standpoint of reproducibility, a shift of 0.2 weight percent nickel can shift the midpoint of the TTR by 25° C.

Hence the alloy manufacturer may find it necessary to remanufacture the alloy or to prepare several melts of slightly different compositions to achieve his intended final composition. Normal melting losses make it exceedingly difficult to anticipate the final composition with adequate precision. The alloy manufacturer can encounter high scrap losses.

U.S. Pat. No. 4,144,057, entitled "Shape Memory Alloys," issued on Mar. 13, 1979, to Keith Melton and Olivier Mercier, discloses Nickel—the use of from 0.5 to 30 weight percent of copper and from 0.01 to 5 weight percent of at least one element selected from the group consisting of aluminum zirconium, cobalt, chrome, and iron in nickel-titanium alloys. They report that the transition temperatures in these alloys are less sensitive to compositional changes. The use of copper, however, is not desirable in some cases. Therefore, it is desirable to have another method of adjusting the TTR. Moreover, even when copper is used, it is desirable to have means of further fine tuning the TTR.

SUMMARY OF THE INVENTION

Accordingly, one object of this invention is to provide a new method of changing the temperature transition range (TTR) of a nickel-titanium alloy having a shape change memory (Nitinol).

Another object of this invention is to provide a method of changing the TTR of a nickel-titanium alloy (Nitinol) having a shape change memory without changing the composition of the alloy.

Still another object of this invention is to provide an easier method of obtaining a nickel-titanium shape change memory alloy (Nitinol) having a given TTR.

Yet another object of this invention is to reduce the amount of waste occurring in the production of a nickel-titanium shape change memory alloy having a specific TTR.

A further object of this invention is to provide a method of providing a nickel-titanium shape change memory alloy (Nitinol) having a more accurate TTR.

These and other objects of this invention are accomplished by providing:

in the process of forming an article with a shape change memory from a nickel-titanium based shape memory alloy by annealing the object at a temperature above the transition temperature range (TTR) while the object is restrained in its permanent shape and then reshaping the object into its intermediate shape at a temperature below the transition temperature range, the improvement comprising:

selecting the annealing temperature to obtain a desired transition temperature range.

BRIEF DESCRIPTION OF THE DRAWINGS

A more complete appreciation of the invention and many of the attendant advantages thereof will be readily appreciated as the same becomes better understood by reference to the following detailed description when considered in connection with the accompanying drawing wherein.

DETAILED DESCRIPTION OF THE PREFERRED EMBODIMENT

Figure 1:
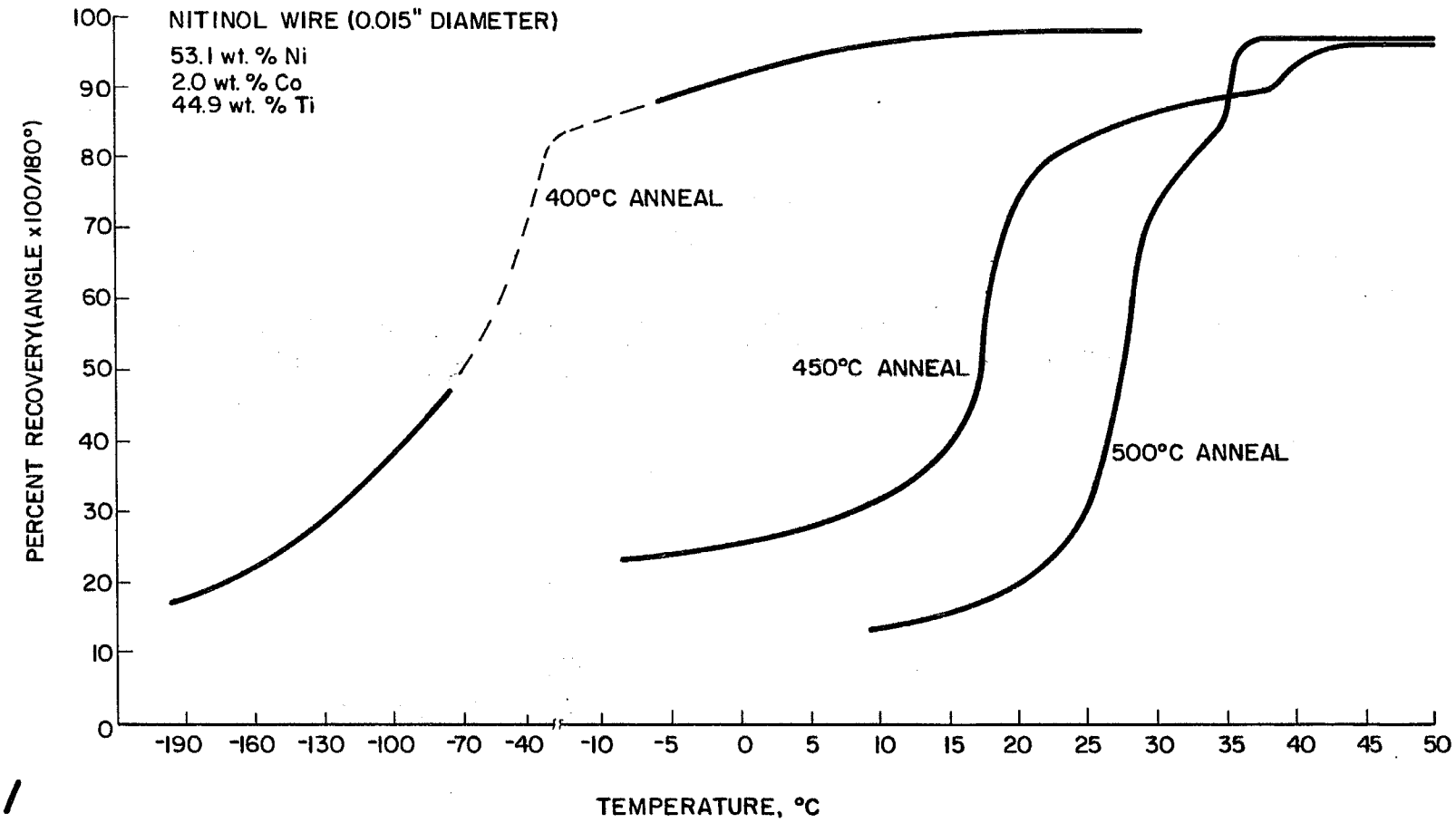
FIG. 1 contains three plots of percent shape recovery versus temperature for 3 Nitinol wires having the same composition of nickel, titanium, and cobalt but which have been anealed at 400° C., 450° C., and 500° C., respectively.

The present invention provides a method by which the shape change temperature range (TTR) of Nitinol (nickel-titanium based) alloys can be varied by selecting the final annealing conditions. Broadly, the method may be applied to all nickel-titanium based alloys which possess shape change memory properties. U.S. Pat. No. 4,144,057 discloses shape memory alloys which may be used which comprise from 23 to 55 weight percent of nickel, 40 to 46.5 weight percent of titanium, 0.5 to 30 weight percent of copper, with the remainder being 0.01 to 5 weight percent of at least one of the following elements: aluminium, zirconium, cobalt, chromium, and iron. Preferred are alloys comprising from 43 to 47 weight percent of titanium, from more than zero to 6 weight percent of cobalt, with the remainder being nickel. More preferred are alloy composed of from 43 to 47 weight percent of titanium with the remainder being nickel. These alloys are prepared by convention means such as arc casting.

Prior to the annealing step, the alloy is cold worked to bring it to a convenient size and shape and to remove any prior shape memory effect which may be present in the alloy. The alloys undergo conventional plastic deformation when they are cold worked. Lattice vacancies (holes where atoms should be) are created. Cold working a minimum of 15% is sufficient to enable the annealing process to control the transition temperature.

Next, the material is formed into its permanent shape. Some additional cold working may occur during this forming step. The material is restrained in this permanent shape during the annealing step.

The critical feature of this invention is the selection of the final annealing temperature. This is based on the discovery that by adjusting the final annealing temperature, the transition temperature range (TTR) can be changed. In general, for a given composition raising the annealing temperature raises the TTR.

The procedure, as illustrated in examples 1–3, is to anneal the shape change objects at different temperatures and measure the resulting TTR's. In this manner the optimum annealing temperature to achieve the desired TTR can determined. Because the TTR is sensitive to even small changes in composition, the annealing temperature must be redetermined for each new batch of alloy. Moreover, the TTR depends on the permanent shape of the object. Therefore, the exact shape must be used in determining the relationship between the annealing temperature and the TTR.

The annealing is performed in a dry, inert atmosphere (e.g., dry helium or argon) to prevent contamination of the alloy. The shape change memory object is heated at the annealing temperature until all of the object is at the annealing temperature; the object is then heated an additional 5 minutes. Heating the alloy beyond this time will have little if any effect. An object may be annealed again at a higher temperature to exhibit a TTR corresponding to that higher annealing temperature; however, the reverse is not true. Thus, an object which had been annealed first at 400° C. and then at 500° C. will exhibit a TTR corresponding to the 500° C. annealing, but an object annealed first at 500° C. and then 400° C. will still exhibit a TTR corresponding to the 500° C. anneal.

After the annealing step, the object is cooled down below the TTR, during which it is still restrained in its permanent shape. After this, the restraint is removed. Next, by using conventional techniques the nickel-titanium based shape change alloy object is formed into another shape, taking care not to cause more than 7 or 8 percent deformation in the material. If the object is heated or allowed to warm to above the transition temperature range (TTR) it will regain its permanent shape.

The TTR of the shape change memory produced by the process of this invention will change if the material is worked. Therefore, the alloys are not to be used in dynamic devices such as nitinol motors. The alloys are useful, however, in prosthetic devices such as artificial knee or elbow joints. Typically, the intermediate form of the device will be easy to insert. Body heat will raise the temperature of the device above the TTR, causing the device to change to its final shape.

To more clearly illustrate this invention, the following examples are presented. It should be understood, however, that these examples are presented merely as a means of illustration and are not intended to limit the scope of the invention in any way.

EXAMPLE 1

An alloy (A-137) of composition 53.1 weight percent nickel 2.0 weight percent cobalt, and 44.9 weight percent titanium was arc melted into ⅜ inch diameter bar under an inert atmosphere. This bar was hot swagged and subsequently drawn into wire at −30° C. The wire was then reduced in diameter to 0.015 inch and separate lengths of it were annealed at temperatures of 400°, 450°, and 500° C. The transition temperatures of the alloy as annealed at the various temperatures are shown in FIG. 1.

It is apparent in the example of A-137 that the final annealing procedure causes a shift in the midpoint of the transition temperature range, for an alloy of given composition, from −70° to +27° C. for the 400° and 500° C. anneals, respectively. As expected, the 450° C. anneal produced an intermediate transition temperature. The percent recovery ordinate on FIG. 1 is the proportional recovery from a "U" bend to a straight wire.

EXAMPLE 2

Figure 2:
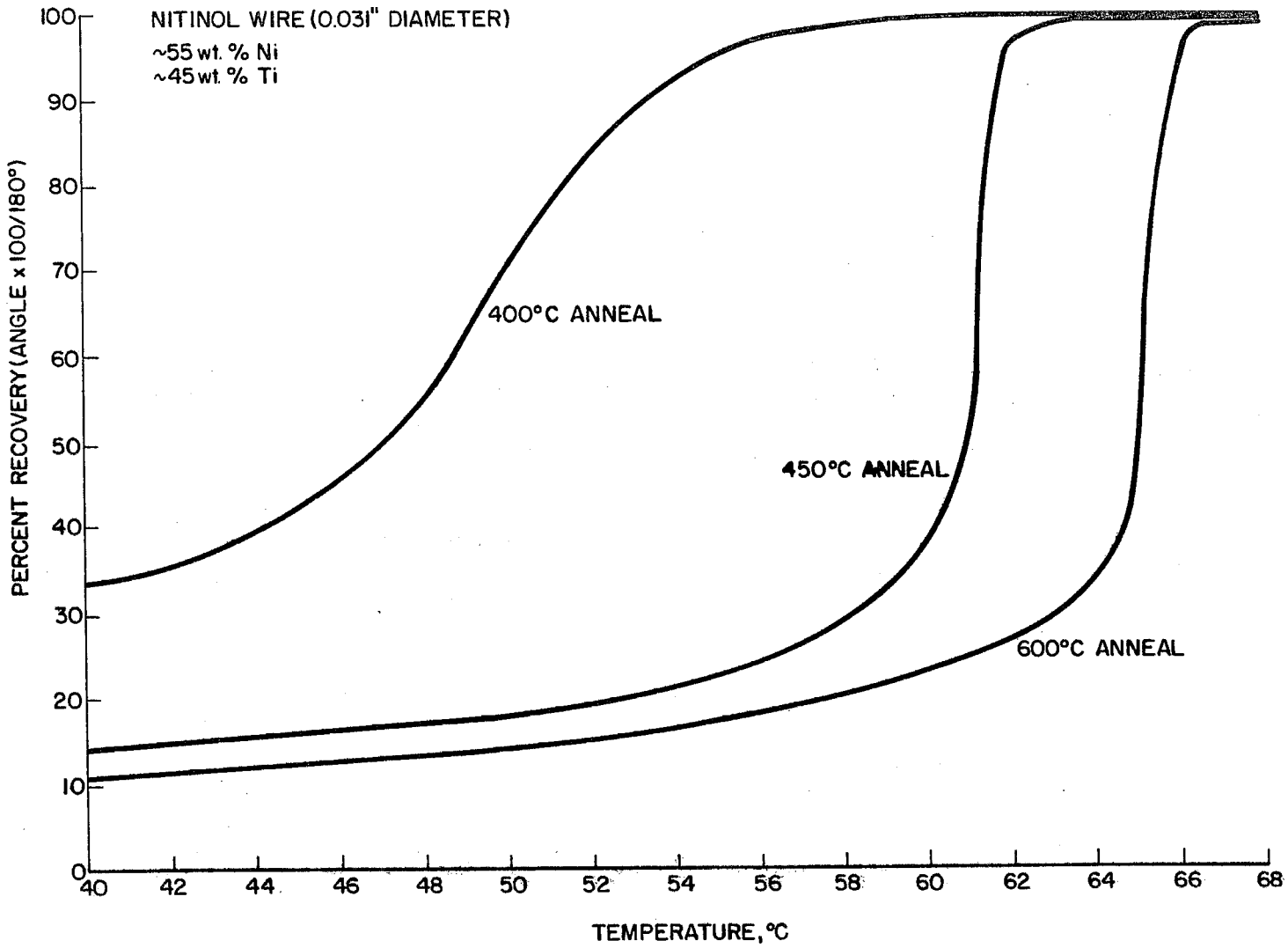
FIG. 2 contains 3 plots of percent shape change versus temperature for 3 Nitinol wires having the same composition of nickel and titanium but which are annealed at 400° C., 450° C., and 500° C., respectively.

An alloy composed of approximately 55 weight percent nickel and 45 weight percent titanium was cold drawn into a wire 0.031 inches in diameter. Three individual sections of this wire were annealed respectively at temperatures between 400° and 600° C. The transition temperature range of this alloy varied as shown in FIG. 2. The results show that the midpoint of the transition temperature range for the wire can be shifted from 47° to 65° C. by selection of the final annealing temperature. As in example 1 (FIG. 1), the percent recovery ordinate on FIG. 2 is the proportionate recovery from a "U" bend to straight wire.

EXAMPLE 3

Figure 3:
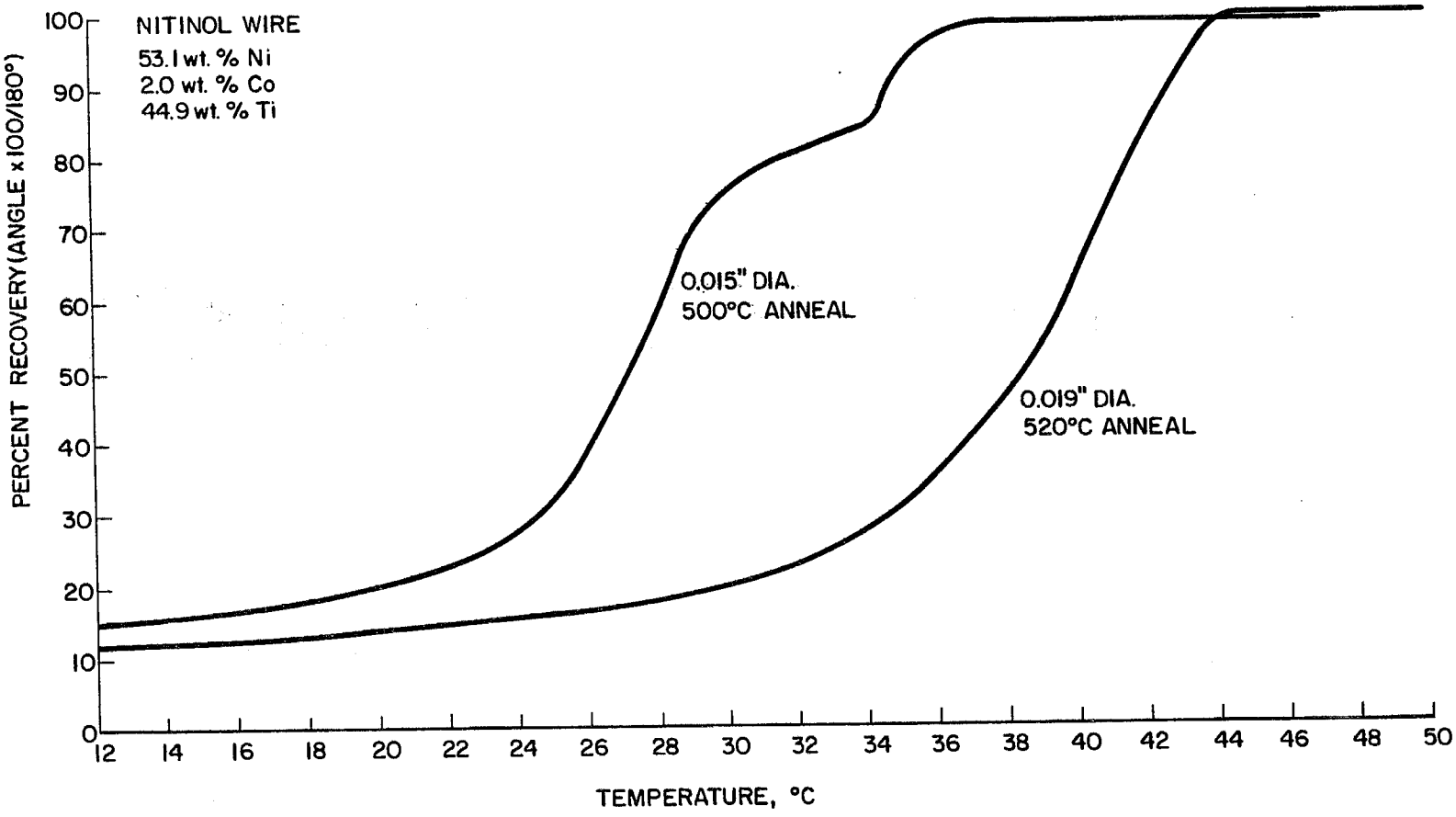
FIG. 3 contains 2 plots of percent shape change versus temperature for 2 Nitinol wires having the same composition as the wires in FIG. 1, one of the wires was annealed at 500° C. and the other at 520° C.

The alloy used in example 1 (53.1 wt % Ni, 2.0 wt % Co, and 44.9 wt % Ti) was cold drawn into a wire 0.019 in diameter. A segment of the wire was annealed at 520° C. The transition temperature range for the wire is shown in FIG. 3. As in example 1 (FIG. 1), the percent recovery ordinate on FIG. 2 is the proportionate recovery from a "U" bend to a straight wire. The recovery curve for the wire which was annealed at 500° C. in example 1 (FIG. 1) has also been included in FIG. 3 for purposes of comparison.

The curves in FIG. 3 illustrate the usefulness of the present method of controlling the transition temperature range by adjusting the final annealing temperature. The wire (0.019" diameter) annealed at 520° C., completes its memory response (TTR) at 45° C. This alloy, if used in vivo (37° C.) will have recovered only 37% of its shape capability at body temperature. Hence, in this condition it would be useless as an internal body device such as a blood clot filter designed to reform itself at 37° C. in vivo. If, however, it were annealed at 500° C., it would be effective in the body since its recovers 98% of its prior shape at 37° C., as is shown for the 0.015 inch diameter wire in FIG. 3.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. In the process of forming an article with a shape change memory from a nickel-titanium based shape change memory alloy by annealing the object at a temperature above the transition temperature range (TTR) while the object is restrained in its permanent shape and then reshaping the object into another shape at a temperature below the transition temperature range, the improvement comprising:

determining the annealing temperature which produces the desired transition temperature range for the article by performing the following steps in order:

(1) forming the alloy into the desired permanent shape of the article;

(2) restraining the article in this permanent shape;

(3) annealing the article at a temperature above the TTR;

(4) cooling the alloy down to a temperature below the TTR;

(5) removing the restraint from the article;

(6) forming the article into an intermediate shape taking care not to cause more than 7 percent deformation in the material;

7) determining the TTR by slowly heating up the article and observing the temperature range over which it recovers its permanent shape; and (8) deciding the next steps as follows:

(a) if the TTR is lower than that desired, steps (2) through (8) are repeated using a higher annealing temperature in step (3);

(b) if the TTR is higher than that desired, steps (1) through (8) are repeated using fresh alloy and a lower annealing temperature in step (3); but (c) if the TTR is that desired, the annealing temperature last used in step (3) is used in the process.

2. The process of claim 1 wherein the nickel-titanium base shape change memory alloy comprises from 43 to 47 weight percent of titanium, from more than zero to 6 weight percent of cobalt, the remainder of the alloy being nickel.

3. The process of claim 1 wherein the nickel-titanium shape change memory alloy comprises from 47 to 53 weight percent of titanium, the remainder of the alloy being nickel.

4. The process of claim 1 wherein the titanium-nickel based shape change memory alloy comprises a mixture of 23 to 55 wt. % nickel, from 40 to 46.5 wt. % titanium and 0.5 to 30 wt. % copper with the balance being from 0.01 to 5 wt % of at least one element selected from the group consisting of aluminum, zirconium, cobalt, chromium and iron.

* * * * *